United States Patent [19]

Litwin et al.

[11] Patent Number: 4,600,612

[45] Date of Patent: Jul. 15, 1986

[54] COORDINATED FLORAL ARRANGEMENT ASSEMBLY SYSTEM AND METHOD

[75] Inventors: Robert G. Litwin; Erwin R. Stone, both of Concord, Calif.; Asset K. Mitra, 620 Montezuma Ct., Walnut Creek, Calif. 94598

[73] Assignee: Asset K. Mitra, Walnut Creek, Calif.

[21] Appl. No.: 704,301

[22] Filed: Feb. 20, 1985

[51] Int. Cl.[4] ..... A41G 1/00

[52] U.S. Cl. ..... 428/23; 156/63; 248/27.8; 428/24; 434/93

[58] Field of Search ..... 428/23, 24, 27.8; 434/93; 156/63

[56] References Cited

U.S. PATENT DOCUMENTS

| | | | |
|---|---|---|---|
| 2,305,567 | 12/1942 | Bole | 428/23 X |
| 2,618,901 | 11/1952 | Braun | 428/23 X |
| 2,981,033 | 4/1961 | Cheetwood | 428/23 X |
| 3,336,697 | 8/1967 | Davis | 428/23 X |
| 3,424,641 | 1/1969 | Separa | 428/23 |
| 3,974,915 | 8/1976 | Mieuli, Jr. | 428/23 X |

*Primary Examiner*—Henry F. Epstein

*Attorney, Agent, or Firm*—Limbach, Limbach & Sutton

[57] ABSTRACT

A coordinated floral arrangement assembly system comprises a plurality of artificial flowers, each of the artificial flowers includes an elongated stem member that has two end portions. A plurality of petals are positioned adjacent to one of the stem member end portions, and a plurality of leaves are positioned on the stem member intermediate of its end portions. In addition, a positional indicator is positioned adjacent to a second of the stem member end portions, the positional indicator has an indicium thereon. The system also comprises a base member, the base member, which is adapted to receive the flowers, has at least one generally horizontal surface. The system further comprises a floral arrangement positional template, the template, which is adapted to be positioned adjacent to the base member horizontal surface, includes a plurality of positional markers each of which has an associated indicium, whereby a stem member that has a particular indicium on its stem member positional indicator is mounted onto the base member immediately adjacent to a template positional marker the associated indicium for which is identical to the stem member indicium.

6 Claims, 2 Drawing Figures

COORDINATED FLORAL ARRANGEMENT ASSEMBLY SYSTEM AND METHOD

TECHNICAL FIELD

This invention relates to floral arrangements, and more particularly, to a system and method for coordinating floral arrangements.

BACKGROUND ART

Floral arrangements are common in the art. With the advent of artificial flowers and accessories such as those made from silk or plastic, decorative floral arrangements have become popular. Its advantages include the capability to last long durations, the capability to be maintained with minimal attention, the capability to withstand environmental stresses and strains, and especially, the capability to be transported with minimal care. Such floral arrangements are particularly desirous at locations where there is minimal amounts of sunlight or humidity, at places where maintenance is troublesome such as places accessible to the public, and when a consumer desires an arrangement that is easy to store and reuse such as seasonal arrangements for Christmas, Easter, or the like.

These prior art floral arrangments are deficient in several aspects. The foremost is their packaging for shipment or storage which tends to be bulky and cumbersome. This is due to the fact that a floral arrangement must be packaged in such a state that the arrangement can be displayed once it is removed from its packaging. Naturally, this packaging must be of sufficient size so as to protect the arrangement in its displayable form. Concurrent with the size disadvantage is the cost of transporting and storing such a bulky package. For example, large volumes are required for floral arrangements which are relatively light in weight. Thus, a substantial portion of the transportation cost is due to the large volume required, and similarly, the volume must be taken into account for the storage cost.

DISCLOSURE OF THE INVENTION

In view of the prior art, it is a major object of the present invention to provide a system and a method of coordinating floral arrangements such that the transportation and storage costs are minimized.

It is another object of the present invention to provide a system and a method of coordinating floral arrangements such that particular designs of floral arrangements are easily reproduced.

In order to accomplish the above and still further objects, the present invention provides a coordinated floral arrangement assembly system. The coordinated assembly system comprises a plurality of artificial flowers, each of the artificial flowers includes an elongated stem member that has two end portions. A plurality of petals are positioned adjacent to one of the stem member end portions, and a plurality of leaves are positioned on the stem member intermediate of its end portions. In addition, a positional indicator is positioned adjacent to a second of the stem member end portions, the positional indicator has an indicium thereon. The system also comprises a base member, the base member, which is adapted to receive the flowers, has at least one generally horizontal surface. The system further comprises a floral arrangement positional template, the template, which is adapted to be positioned adjacent to the base member horizontal surface, includes a plurality of positional markers each of which has an associated indicium, whereby a stem member that has a particular indicium on its stem member positional indicator is mounted onto the base member immediately adjacent to a template positional marker the associated indicium for which is identical to the stem member indicium.

Other objects, features, and advantages of the present invention will appear from the following detailed description of the best mode of a preferred embodiment, taken together with the accompanying drawings.

BEST MODE FOR CARRYING OUT THE INVENTION

Figure 1:
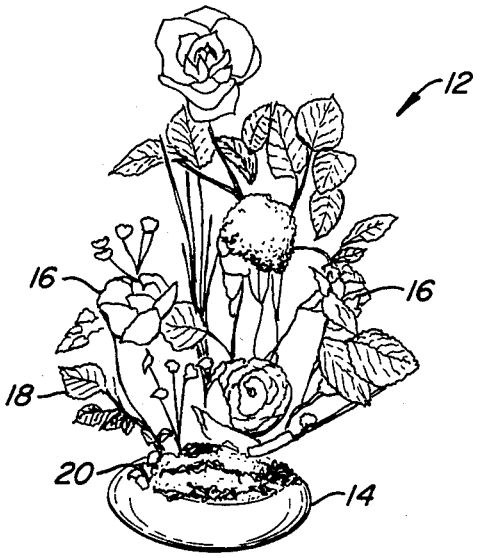
FIG. 1 is a perspective view of a floral arrangement utilizing the present invention.

Referring to FIG. 1, there is shown a floral arrangement, generally designated 12. Floral arrangement 12 comprises a holder 14 in which a plurality of flowers 16 are positioned. In addition, other decorative accessories such as leaves 18 and moss 20 compliment flowers 16 in arrangement 12. Flower 16, accessories 18 and 20 are made from conventional materials such as silk, plastic, or the like.

In the prior art, such a floral arrangement was placed into a container for shipping or storage. Since the arrangement is in its ultimate display form, the shipping carton must be of sufficient dimension so as not to damage the particular arrangement. Thus, such shipping and storage cartons need to be relatively bulky and cumbersome. Moreover, relatively large volume of space was needed to store such large cartons.

Figure 2:
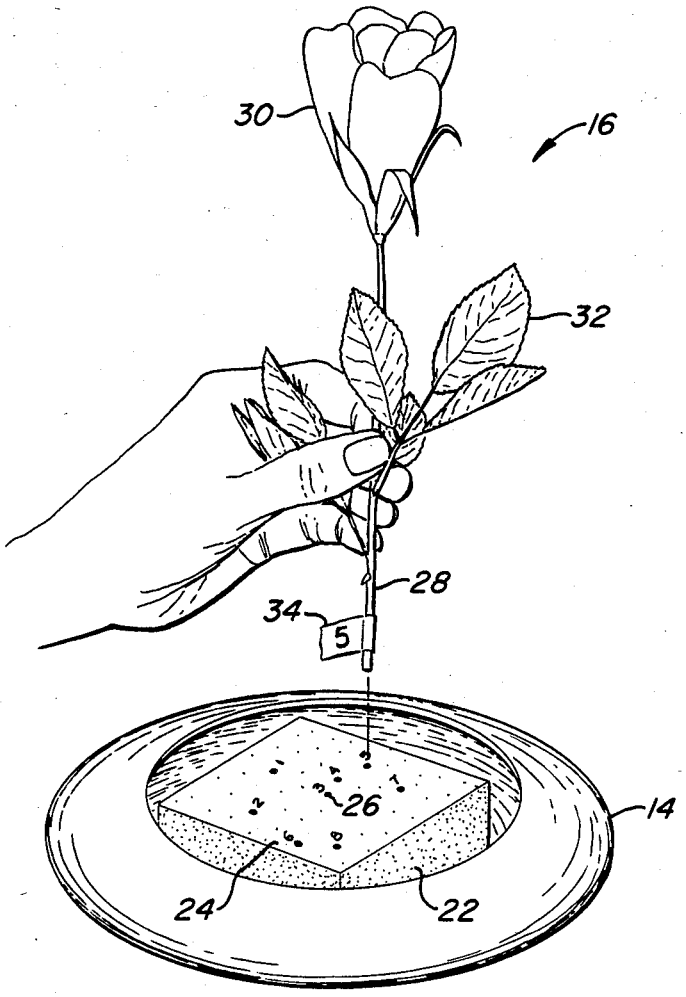
FIG. 2 is a perspective, diagrammatical view of the present invention.

To alleviate these disadvantages in the prior art, the present invention is utilized. As best illustrated in FIG. 2, a foam base 22 is positioned within holder or vase 14. Foam base 22 in the preferred embodiment is manufactured from Styrofoam. Positioned atop foam base 22 is a template 24. Template 24 comprises a plurality of positional markers 26 each of which is designated by a numeral. Positional markers 26 in the preferred emboidment are darkened circles. Each flower 16 or accessory 18 comprises an elongated stem member 28, petals 30, and other decorative attachments 32 such as leaves. In particular, flowers 16 has a positional indicator or tag 34 that is attached to the lower portion of stem member 28. Positonal tag 34 has a numeral that corresponds to one of the plurality of numerals which are associated with position markers 26 of template 24.

A user would position the lower portion of stem 28 that has a particular numeral on its positional tag 34, e.g., the number 5, atop the darkened positional marker 26 the associated numeral for which is identical to the numeral of positional tag 34, e.g., the number 5. Thus positioned, the user then forces stem 28 into foam base 22 such that flower 16 is able to stand unassisted. In this fashion, other flowers 16 and accessories 18 are mounted on foam base 22, i.e., each flower 16 or accessory 18 is mounted immediately adjacent to a foam base position marker 26 the numeral for which corresponds with the numeral of its positional tag 34.

In the alternative, instead of using numerals as matching indicators, color and other indicia may be employed. For example, positional marker 26 on template 24 may be darkened with a particular color, e.g., the color orange. Correspondingly, stem positional tag 34 may be colored orange. Thus, the user of a flower 16 would mount that flower on foam base 22 immediately adjacent to a template positional marker 26 the color for which is identical to the color of the positional tag 34 that is attached to its stem 28. Instead of using a colored positional tag 34, that particular color may be painted onto the lower portion of stem 28.

In use, vase 14, flowers 16, and accessories 18 and 20 are placed in a relatively small-sized carton, not shown, with flowers 16 and accessories 18 and 20 in their disassembled state. Vase 14, foam base 22, and template 24 are also placed in this shipping carton.

At the work site, the contents of the shipping carton are first removed from the carton. Foam base 22 is then positioned within vase 14. Template 24 is then positioned atop foam base 22. The user then selects a flower 16 or accessory 18 that has a positional tag 34 attached to the lower portion of its stem 28. After matching the numeral on that positional tag 34 with a position marker 26 of template 24 that has the identical numeral, the user inserts stem 28 into foam base 22. In this fashion, other flowers 16 and accessories 18 are mounted onto foam base 22. Moss 20 is then used to hide foam base 22 from view and to decorate arrangement 12. In the preferred embodiment, it is recommended that flower 16 and accessories 18 be mounted in a sequential manner, e.g., the stem 28 with positional tag 34 that has the numeral "1" be mounted first immediately adjacent to positional marker 26 that has an associated numeral "1". The stem 28 with a numeral "2" on its positonal tag 34 be mounted next. Thus, floral arrangement 12 is created.

Utilizing this floral arrangement system, flowers 16 accessories 18 may be dismounted from foam base 22 and the entire dismounted arrangement 12 can be stored away. This is especially useful in relation to seasonal decorations. At another appropriate time, flowers 16 and accessories 18 may be mounted once again on foam base 22 such that floral arrangement 12 is recreated.

It will be apparent to those skilled in the art that various modifications may be made within the spirit of the invention and the scope of the appended claims. For example, floral arrangement 12 need not be an arrangement with flower petals, but rather an artificial bush or tree. In addition, foam base 22 may be selected from any material that is capable of maintaining a stem 28 in a generally upright position. Moreover, template 24 need not be a discrete element, but rather an element that is adhered to foam base 22 or even imprinted on foam base 22. Further, numerals on positional tags 34 and numerals associated with positional markers 26 of template 24 may be replaced by other indicia such as symbols or alphabet letters. For example, Braille or other tactile indicators.

We claim:

1. A coordinated floral arrangement assembly system, comprising a plurality of artificial flowers, each of said artificial flowers includes an elongated stem member that has two end portions, a plurality of petals which are positioned adjacent to one of said stem member end portions, a plurality of leaves which are positioned on said stem member intermediate of said end portions, and a positional indicator positioned adjacent to a second of said stem member end portions, said positional indicator has an indicium thereon;

a base member, said base member, which is adapted to receive said flowers, has at least one generally horizontal, imperforate surface; and a floral arrangement positional template, said template, which is adapted to be positioned atop said foam base member horizontal surface, has an imperforate surface that includes a plurality of positional markers which are in coplanar relationship with said template surface, each of said markers has an associated indicium, whereby a stem member that has a particular indicium on its stem member positional indicator is mounted onto said base member by perforating said template surface immediately adjacent to a template positional marker the associated indicium for which is identical to said stem member indicium.

2. A coordinated floral arrangement assembly system, comprising a plurality of artificial flowers, each of said artificial flowers includes an elongated stem member that has two end portions, a plurality of petals which are positioned adjacent to one of said stem member end portions, a plurality of leaves which are positioned on said stem member intermediate of said end portions, and a positional indicator positioned adjacent to a second of said stem member end portions, said positional indicator has a numeral thereon;

a base member, said base member, which is adapted to receive said flowers, has at least one generally horizontal, imperforate surface; and a floral arrangement positional template, said template, which is adapted to be positioned atop said foam base member horizontal surface, has an imperforate surface that includes a plurality of positional markers which are in coplanar relationship with said template surface, each of said markers has an associated numeral, whereby a stem member that has a particular numeral on its stem member positional indicator is mounted onto said base member by perforating said template surface immediately adjacent to a template positional marker the associated numeral for which is identical to said stem member numeral.

3. A coordinated floral arrangement assembly system, comprising a plurality of artificial flowers, each of said artificial flowers includes an elongated stem member that has two end portions, a plurality of petals which are positioned adjacent to one of said stem members end portions, a plurality of leaves which are positioned on said stem member intermediate of said end portions, and a positional indicator positioned adjacent to a second of said stem member end portions, said positional indicator has a particular color thereon;

a base member, said base member, which is adapted to receive said flowers, has at least one generally horizontal, imperforate surface; and a floral arrangement positional template, said template, which is adapted to be positioned atop said base member horizontal surface, has an imperforate surface that includes a plurality of positional markers which are in coplanar relationship with said template surface, each of said markers has an associated color, whereby a stem member that has a particular color on its stem member positional indicator is mounted onto said base member by perforating said template surface immediately adjacent to a template positional marker the associated color for which is identical to said stem member color.

4. A method of assembling floral arrangements, comprising providing a plurality of artificial flowers, each of said artificial flowers includes an elongated stem member that has two end portions;

providing a positional indicator that is positioned adjacent to one of said stem member end portions, said positional indicator has an indicium thereon;

providing a base member, said base member, adapted to receive said flowers, has at least one generally horizontal, imperforate surface;

providing a floral arrangement positional template, said template has an imperforate surface that includes a plurality of positional markers which are in coplanar relationship with said template surface, each of said markers has an associated indicium;

positioning said template atop said base member;

positioning said stem member of an aritificial flower that has a particular indicium on said positional indicator immediately adjacent to a template positional marker the associated indicium of which is identical to said stem member indicium; and mouning said stem member into said base member by perforating said template surface, whereby a floral arrangement is assembled.

5. A method of assembling floral arrangements, comprising providing a plurality of artificial flowers, each of said artificial flowers includes an elongated stem member that has two end portions;

providing a positional indicator that is positioned adjacent to one of said stem member end portions, said positional indicator has a numeral thereon;

providing a base member, said base member, adapted to receive said flowers, has at least one generally horizontal, imperforate surface;

providing a floral arrangement positional template, said template has an imperforate surface that includes a plurality of positional markers which are in coplanar relationship with said template surface, each of said markers has an associated numeral;

positioning said template atop said base member;

positioning said stem member of an artificial flower that has a particular numeral on said positional indicator immediately adjacent to a template positional marker the associated numerals of which is identical to said stem member numeral; and mounting said stem member into said base member by perforating said template surface, whereby a floral arrangement is assembled.

6. A method of assembling floral arrangements, comprising providing a plurality of artificial flowers, each of said artificial flowers includes an elongated stem member that has two end portions;

providing a positional indicator that is positioned adjacent to one of said stem member end portions, said positional indicator has a color thereon;

providing a base member, said base member, adapted to receive said flowers, has at least one generally horizontal, imperforate surface;

providing a floral arrangement positional template, said template has an imperforate surface that includes a plurality of positional markers, which are in coplanar relationship with said template surface, each of said markers has an associated color;

positioning said template atop said base member;

positioning said stem member of an artificial flower that has a particular color on said positional indicator immediately adjacent to a template positional marker the associated color of which is identical to said stem member color; and mounting said stem member into said base member by perforating said template surface, whereby a floral arrangement is assembled.

* * * * *